US009190225B2

(12) United States Patent
Faulkner et al.

(10) Patent No.: US 9,190,225 B2
(45) Date of Patent: Nov. 17, 2015

(54) REMOTELY OPERABLE ELECTRICAL DISCONNECT APPARATUS

(71) Applicant: EATON CORPORATION, Cleveland, OH (US)

(72) Inventors: Mark A. Faulkner, Greenwood, SC (US); Jerry S. Wang, Arden, NC (US)

(73) Assignee: EATON CORPORATION, Cleveland, OH (US)

( * ) Notice: Subject to any disclaimer, the term of this patent is extended or adjusted under 35 U.S.C. 154(b) by 85 days.

(21) Appl. No.: 14/069,701

(22) Filed: Nov. 1, 2013

(65) Prior Publication Data

US 2015/0123752 A1 May 7, 2015

(51) Int. Cl.

| | |
|---|---|
| ***H01H 3/00*** | (2006.01) |
| ***H01H 9/00*** | (2006.01) |
| ***H01H 51/00*** | (2006.01) |
| ***H01H 3/26*** | (2006.01) |
| ***H01H 3/02*** | (2006.01) |

(52) U.S. Cl.
CPC *H01H 3/264* (2013.01); *H01H 3/02* (2013.01)

(58) Field of Classification Search
CPC ..... H01H 71/56; H01H 27/002; H01H 3/08; H01H 3/14; H01H 3/264; H01H 3/02
USPC ..... 335/71–77, 160, 161; 200/330, 331, 200/400
See application file for complete search history.

(56) References Cited

U.S. PATENT DOCUMENTS

| | | | | |
|---|---|---|---|---|
| 4,691,180 | A | 9/1987 | Grunert et al. | |
| 5,111,009 | A * | 5/1992 | Chan et al. | 200/330 |
| 6,797,903 | B1 * | 9/2004 | Winslett et al. | 200/331 |
| 7,238,903 | B2 * | 7/2007 | Fischer | 200/330 |
| 7,368,675 | B2 * | 5/2008 | Ishido et al. | 200/331 |
| 7,462,792 | B1 * | 12/2008 | Hellmers et al. | 200/50.33 |
| 7,544,907 | B1 | 6/2009 | Moffat et al. | |
| 8,068,320 | B2 | 11/2011 | Faulkner et al. | |
| 2013/0250539 | A1 | 9/2013 | Faulkner et al. | |

OTHER PUBLICATIONS

Eaton, Cutler-Hammer, "Spot Network Systems" Technical Data, Aug. 1999, pp. 1-17.
Eaton, "VaultGard network communication for electrical vault systems", http://www.eaton.com/Eaton/ProductsServices/Electrical/ProductsandServices/ElectricalDi . . . , Sep. 24, 2013, p. 1.

* cited by examiner

*Primary Examiner* — Bernard Rojas
(74) *Attorney, Agent, or Firm* — Eckert Seamans Cherin & Mellott, LLC; Philip E. Levy; John P. Powers

(57) ABSTRACT

An electrical disconnect apparatus includes a housing having an interior and an exterior, first and second conductors extending from the exterior into the interior, a movable conductor, and an actuator assembly coupled to the housing. The movable conductor has a connected position in which the movable conductor electrically connects the first conductor and the second conductor, and a disconnected position in which the first conductor is electrically disconnected from the second conductor. The actuator assembly is adapted to move the movable conductor between the connected position and the disconnected position, and can be actuated manually or automatically.

13 Claims, 6 Drawing Sheets

REMOTELY OPERABLE ELECTRICAL DISCONNECT APPARATUS

BACKGROUND

1. Field

The disclosed concept pertains generally to power distribution equipment and, more particularly, to electrical disconnect apparatus.

2. Background Information

Two primary objectives of the electric utility industry in the delivery of electrical power are safety and reliability.

Secondary network systems, for example, are used in certain locations such as downtown business districts and commercial areas in order to provide a high degree of service continuity. In such secondary network systems, a failure of any one distribution line will not result in an interruption of service to the customers since electrical power will be supplied to the customers over the remaining distribution lines. A network protector is employed in the event of a failure or fault to prevent power from the secondary network from being fed back through the network transformers to the fault. When a network protector is approached for, for example, maintenance, testing, or repair, the network protector must be electrically and physically disconnected from the power distribution equipment on both the network transformer side and the secondary network side. By way of example, arc flash, which is a dangerous condition associated with the explosive release of energy caused by an electrical arc due to either a phase-to-ground or phase-to-phase fault, is a serious safety concern.

FIGS. 1 and 2 show an example electrical disconnect apparatus 1, which includes a housing 100 and a connection device 200 having a handle 210. The housing 100 includes a first conductor 110 having a first conductive surface 111 configured to electrically connect to a first external circuit (not shown), and a second conductor 120 (FIG. 2) having a second conductive surface 121 (FIG. 2) configured to electrically connect to a second external circuit (not shown). As shown in FIG. 2, the first conductor 110 further includes a first receptacle 112 and a first flexible conductor 113, and the second conductor 120 further includes a second receptacle 122 and a second flexible conductor 123. The handle 210 is attached to a fuse 230, which includes opposing first and second conductive end portions 231,232 mechanically coupled by a tube 233 and electrically connected by a fusible element 234.

When the fuse 230 is inserted into the housing 100, it is received by the first receptacle 112 and the second receptacle 122 such that the first conductive end portion 231 contacts the first flexible conductor 113 and the second conductive end portion 232 contacts the second flexible conductor 123 to electrically connect the first and second conductors 110,120, which in turn creates a conductive circuit with the first and second flexible conductors 113,123 and the first and second conductive surfaces 111,121. Operating (e.g., turning and pulling) the handle 210 to partially remove the fuse 230 from the housing 100 moves the fuse 230 out of electrical contact with at least one of the flexible conductors 113,123, thereby electrically disconnecting the first conductor 110 from the second conductor 120. Thus, when the electrical disconnect apparatus 1 is employed, for example, between a network protector and an electrical network, a technician can relatively easily determine whether the network protector is isolated from the electrical network based on the presence or absence of the connection device 200 in the housing 100. The technician can also relatively easily electrically connect or disconnect the network protector from the electrical network by operating the handle 210 to insert or remove the connection device 200. However, this requires direct physical contact and manual operation of the connection device 200 on the part of the technician.

There is, therefore, room for improvement in electrical disconnect apparatus.

SUMMARY

These needs and others are met by embodiments of the disclosed concept, which are directed to an electrical disconnect apparatus, which among other benefits may be operated automatically, for example, from a remote location.

As one aspect of the disclosed concept, an electrical disconnect apparatus comprises: a housing including an interior and an exterior; a first conductor extending from the exterior into the interior; a second conductor extending from the exterior into the interior; a movable conductor having a connected position in which the movable conductor electrically connects the first conductor and the second conductor, and a disconnected position in which the first conductor is electrically disconnected from the second conductor; and an actuator assembly coupled to the housing and being adapted to move the movable conductor between the connected position and the disconnected position. The actuator assembly can be actuated manually or automatically.

The actuator assembly may comprise a base, an enclosure, a mount, a manual actuating mechanism, and an automatic actuating assembly. The base may couple the enclosure to the exterior of the housing, and the enclosure may enclose at least a portion of the automatic actuating assembly. The automatic actuating assembly may comprise a drive assembly coupled to the mount and an actuator for actuating the drive assembly to move the movable conductor with respect to the housing. The manual actuating mechanism may be a manual interlock, wherein the manual interlock is structured to mechanically engage the housing in order to manually lock the movable conductor in the connected position and to mechanically disengage the housing in order to manually retract and disconnect the movable conductor.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "controller" means a programmable analog and/or digital device that can store, retrieve, communicate and process data; a computer; a workstation; a personal computer; a smart phone; a microprocessor; a microcontroller; a microcomputer; a central processing unit; a mainframe computer; a mini-computer; a gateway; a server; a networked processor; a programmable logic controller (PLC); or any suitable communication system, processing device or apparatus.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 3:
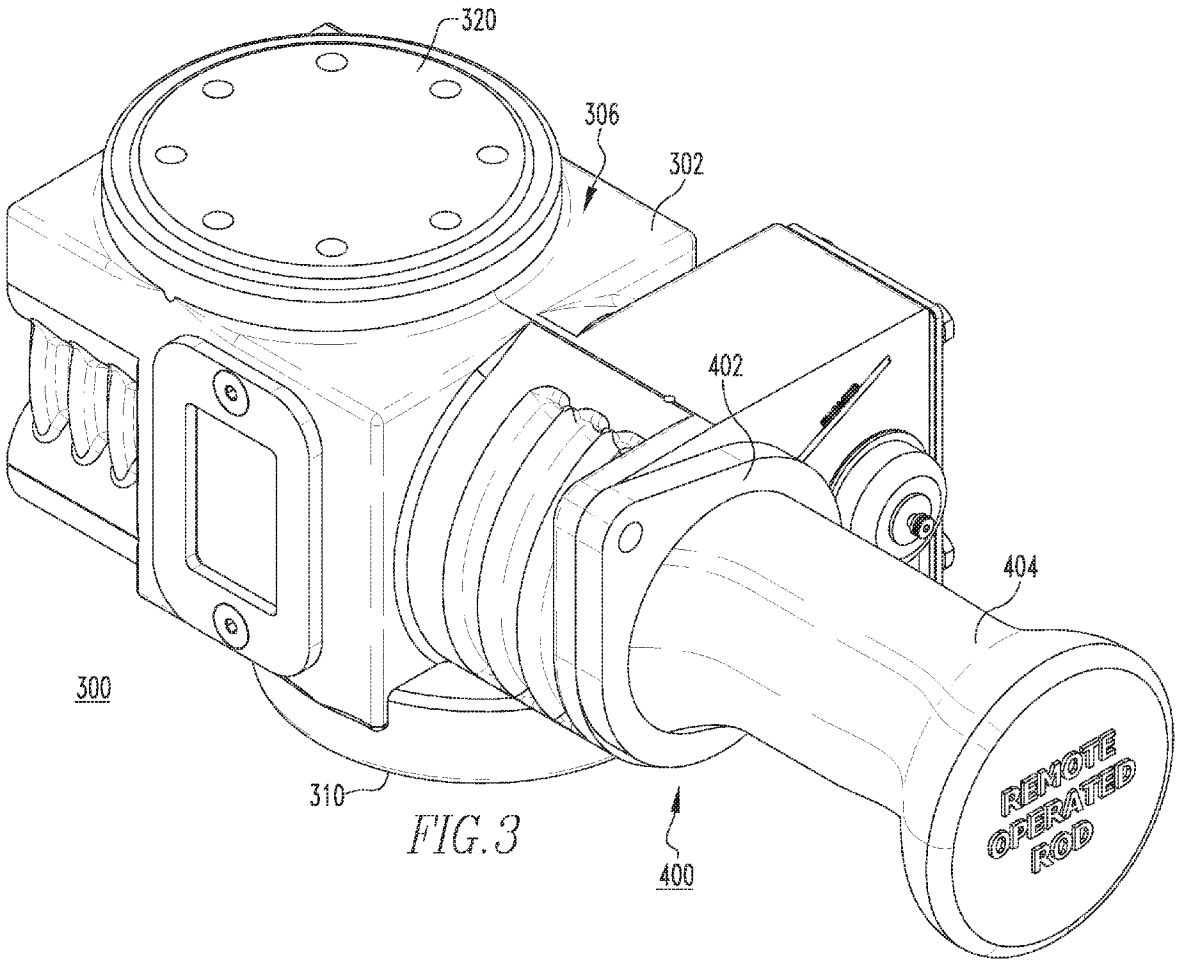
FIG. 3 is an isometric view of an electrical disconnect apparatus in accordance with an embodiment of the disclosed concept.
Figure 4A:
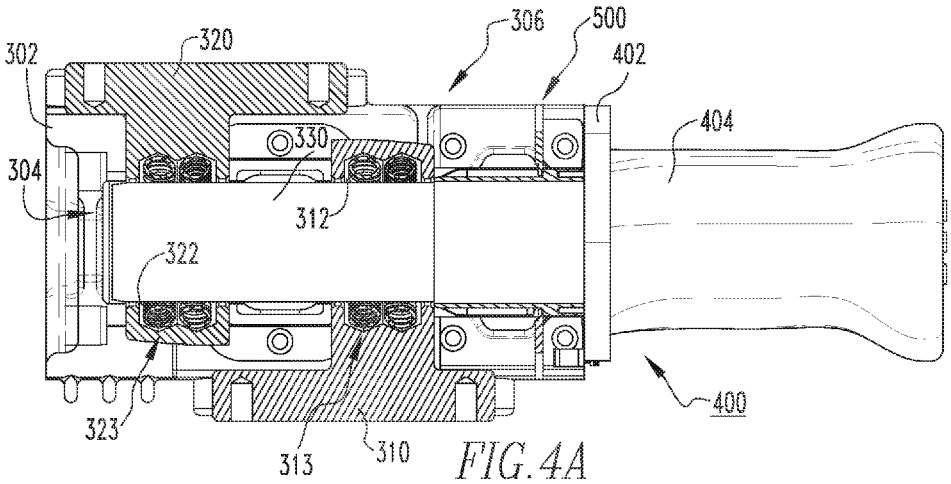
FIG. 4A is a side elevation partially in section view of the electrical disconnect apparatus of FIG. 3, shown in the extended position.
Figure 4B:
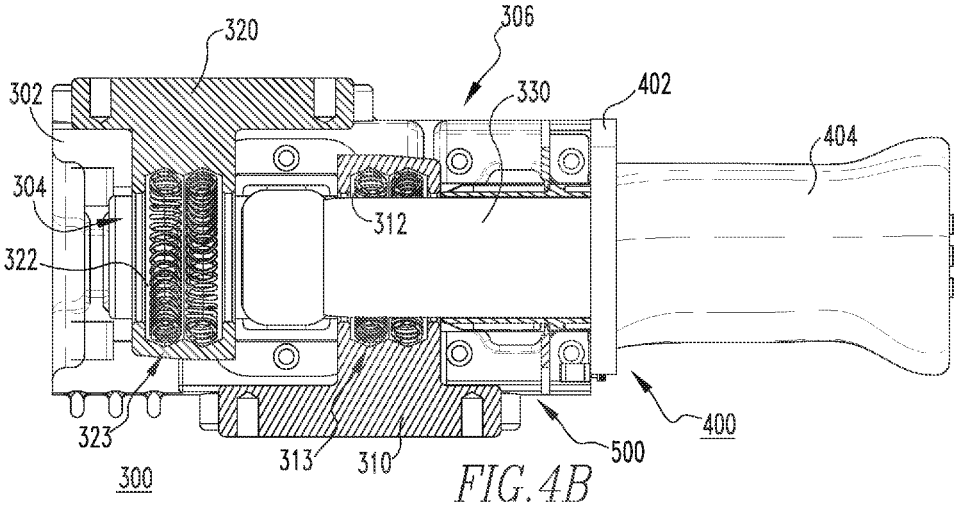
FIG. 4B is a side elevation partially in section view of the electrical disconnect apparatus of FIG. 4A, shown in the retracted position.

FIG. 3 shows an electrical disconnect apparatus 300 including a housing 302 having an interior 304 (FIGS. 4A and 4B) and an exterior 306. As best shown in FIGS. 4A and 4B, first and second conductors 310,320 extend from the exterior 306 into the interior 304 on opposite sides of the housing 302. Although not shown herein for economy of disclosure and ease of illustration, it will be appreciated that the first and second conductors 310,320 are adapted to be electrically connected to first and second corresponding external electrical circuits (not shown).

The electrical disconnect apparatus 300 further includes a movable conductor 330. The movable conductor 330 moves between the connected (e.g., extended) position of FIG. 4A, in which the movable conductor 330 electrically connects the first and second conductors 310,320, and the disconnected (e.g., refracted) position of FIG. 4B in which the movable conductor 330 is spaced apart from the second conductor 320, thereby electrically disconnecting the first and second conductors 310,320.

In the example shown and described herein, the movable conductor 330 is an elongated rod, the first conductor includes a first receptacle 312 and a flexible conductor 313 disposed around the first receptacle 312, and the second conductor 320 includes a second receptacle 322 and a second flexible conductor 323 disposed around the second receptacle 322. In operation, when the elongated rod 330 is disposed in the connected position of FIG. 4A, it extends into the interior 304 of the housing 302 through the first and second flexible conductors 313,323, thereby electrically connecting the first and second conductors 310,320. When the elongated rod 330 is disposed in the disconnected position of FIG. 4B, it is retracted and spaced from the second flexible conductor 323, as shown, thereby electrically disconnecting the first and second conductors 310,320.

Figure 1:
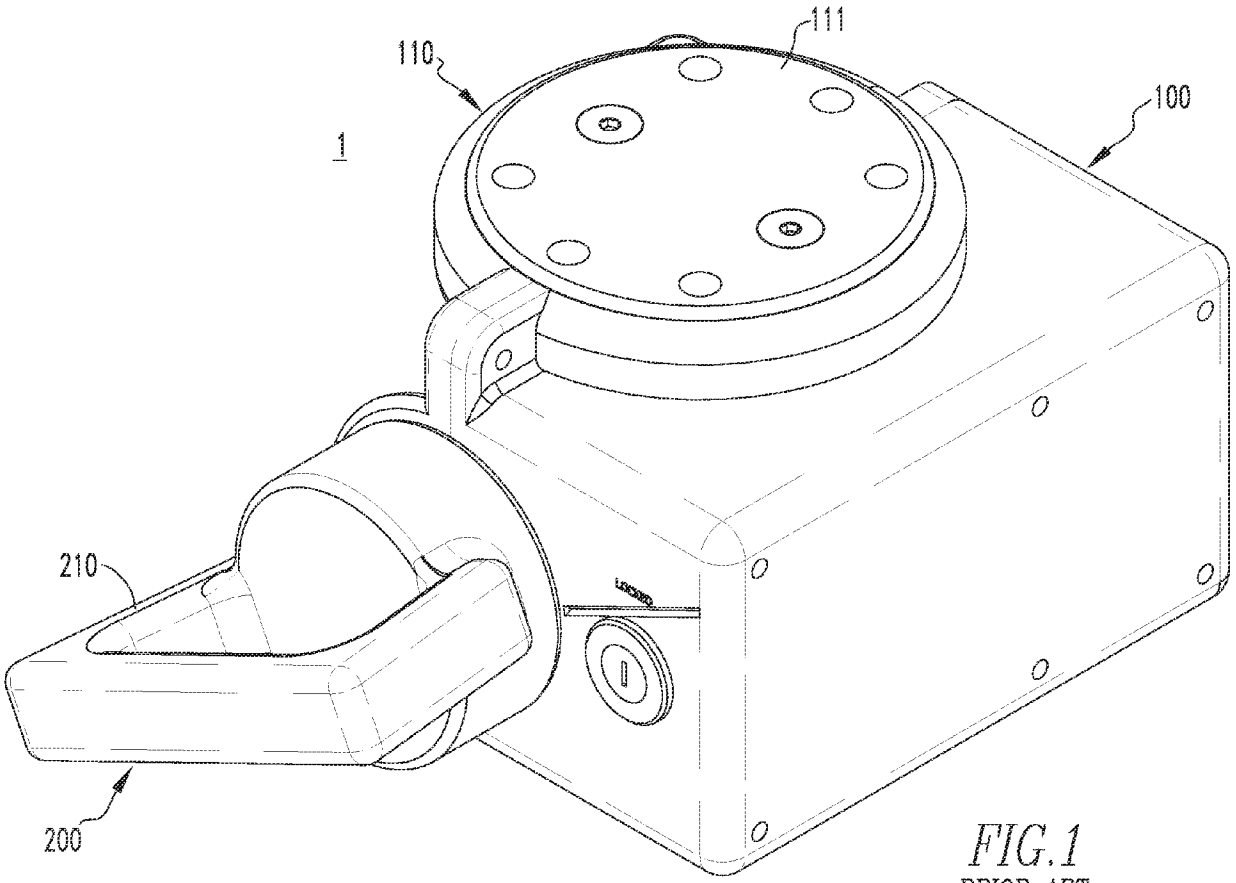
FIG. 1 PRIOR ART
FIG. 1 is an isometric view of a known electrical disconnect apparatus.
Figure 2:
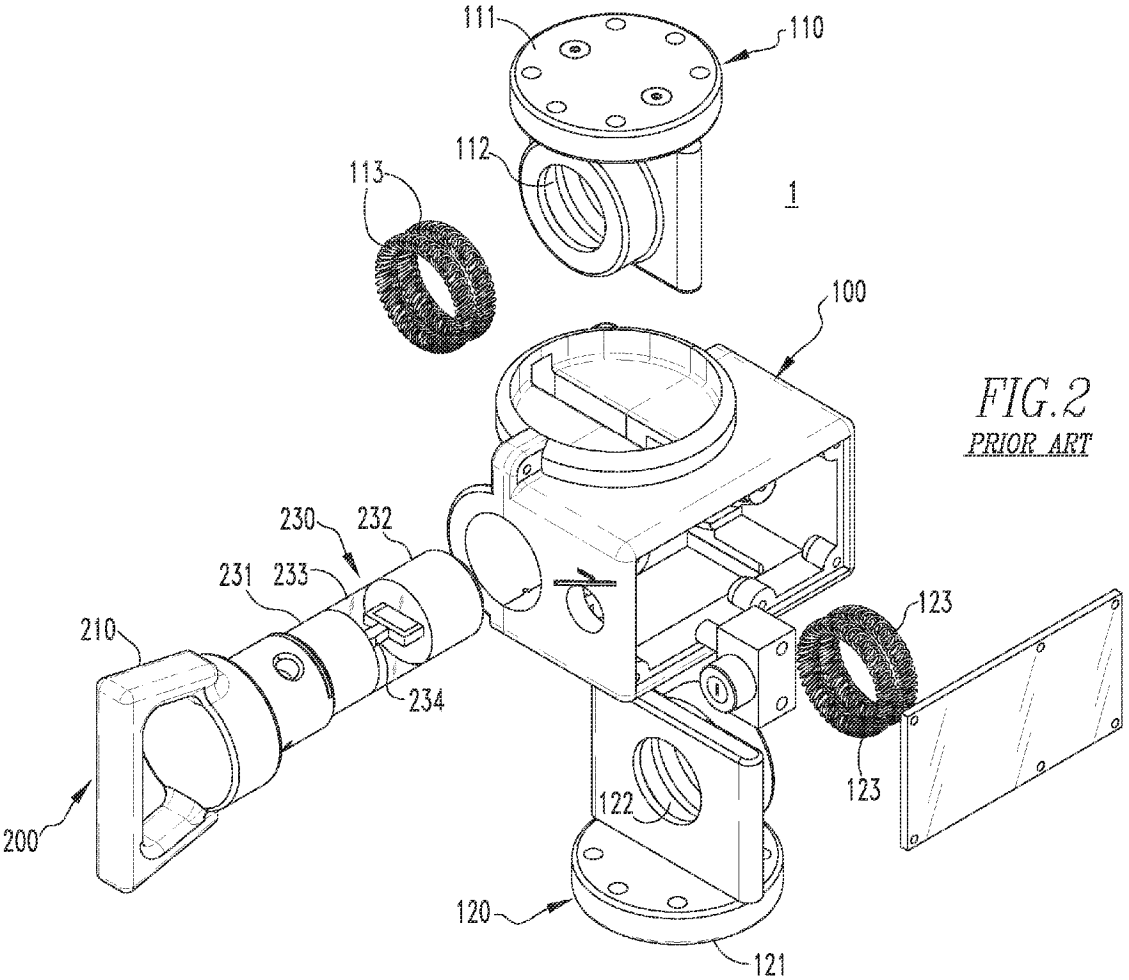
FIG. 2 PRIOR ART
FIG. 2 is an exploded isometric view of the electrical disconnect apparatus of FIG. 1.
Figure 5:
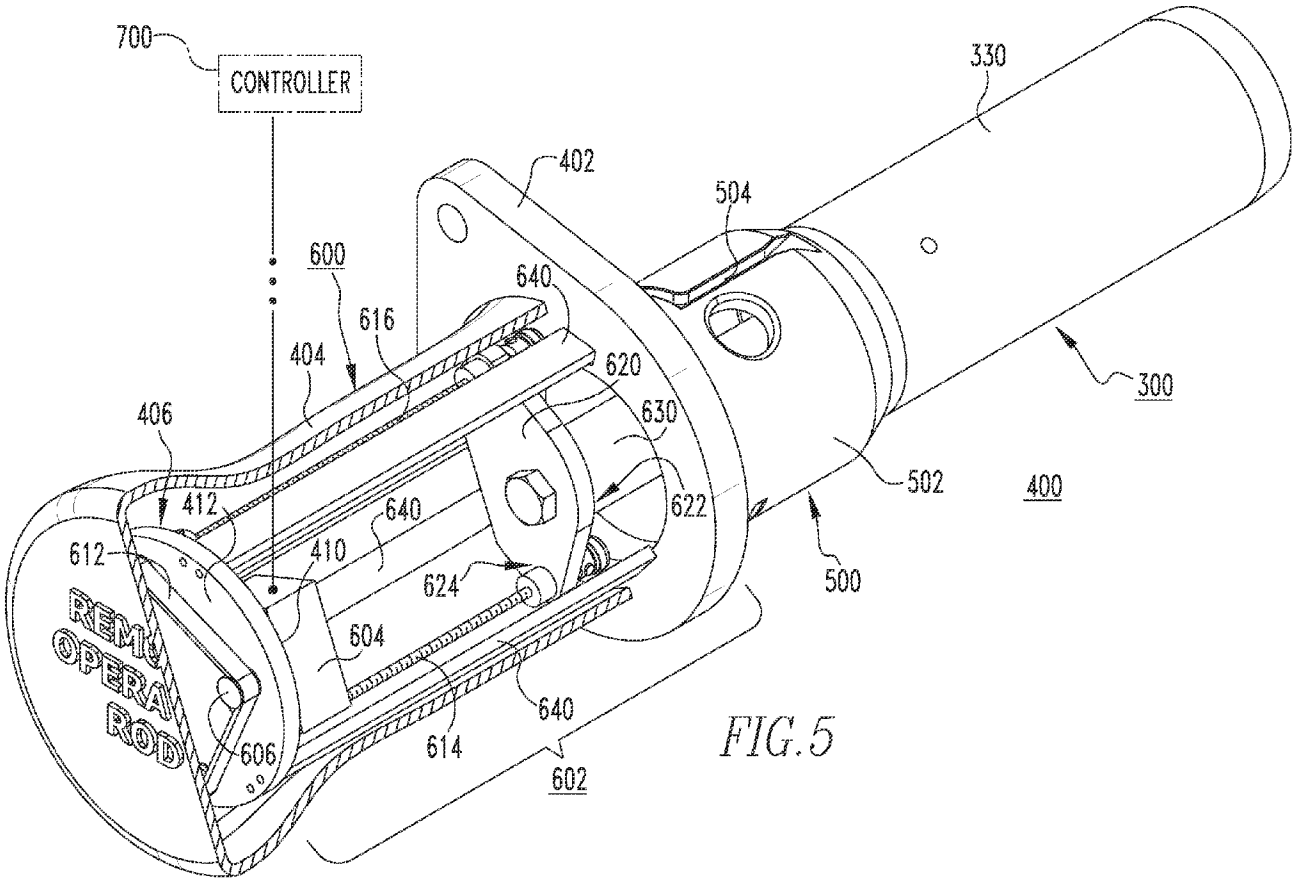
FIG. 5 is an isometric partially in section view of the electrical disconnect apparatus of FIG. 4B.
Figure 6:
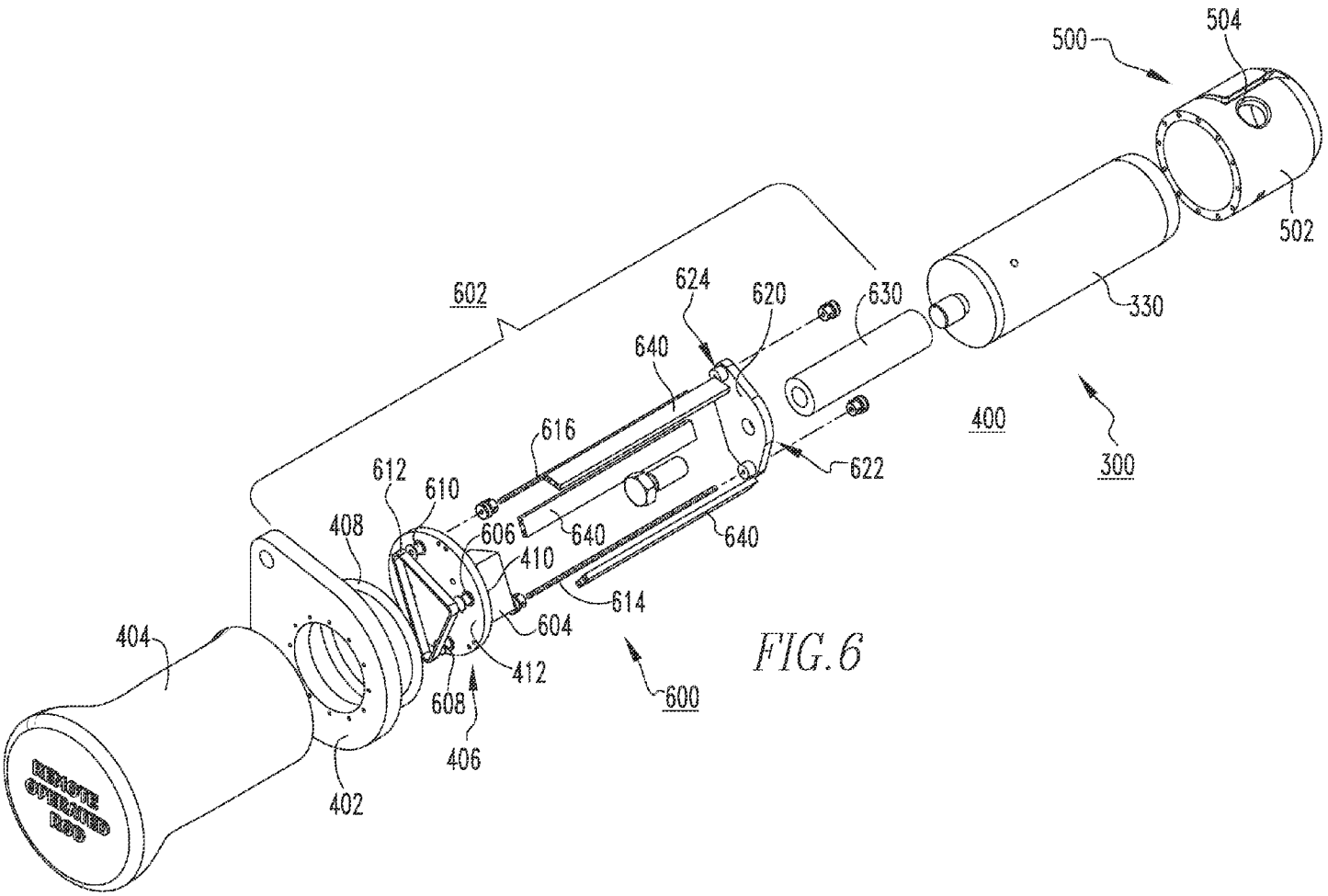
FIG. 6 is an exploded isometric view of the electrical disconnect apparatus of FIG. 5.

Continuing to refer to FIGS. 4A and 4B, and also to FIGS. 5 and 6, it will be appreciated that the non-limiting example electrical disconnect apparatus 300 shown and described herein, further includes an actuating assembly 400, which is coupled to the housing 302 and is adapted to move the movable conductor 330 between the aforementioned connected (e.g., extended) position (FIG. 4A) and disconnected (e.g., refracted) position (FIG. 4B). Unique to the disclosed concept is the advantageous ability of the actuator assembly 400 to be actuated either manually or automatically. In other words, unlike known electrical disconnect apparatus designs (see, for example, electrical disconnect apparatus 1 of FIGS. 1 and 2), which require direct physical contact by a user to manually operate the electrical disconnect apparatus 1 (FIGS. 1 and 2), the disclosed electrical disconnect apparatus 300 can advantageously be operated not only in such a manual mode of operation, but also automatically from a remote location, without requiring direct user contact. More specifically, the automatic actuating assembly 600 (described in greater detail hereinbelow) can be operated by any known or suitable wired or wireless mechanism or means from a safe location distal from the electrical disconnect apparatus 300.

Additionally, the disclosed electrical disconnect apparatus 300 does not require separate electrical devices or other means for effectuating such automatic disconnection. That is, the automatic actuating assembly 600 of the electrical disconnect apparatus 300 is advantageously "built-in" (i.e., integral). The integral nature of such automatic actuating assembly 600, among other benefits, reduces the overall size (i.e., footprint) of the design and allows for quick failsafe remote isolation. Thus, the disclosed concept provides a significant safety measure for addressing and avoiding concerns associated with, for example, arc flash or other potentially hazardous conditions for technicians and other operating personnel.

The actuator assembly 400 of the example electrical disconnect apparatus 300 includes a base 402, an enclosure 404, a mount 406, a manual actuating mechanism 500 for manually operating the electrical disconnect apparatus 300, and the aforementioned automatic actuating assembly 600 for automatically operating the electrical disconnect apparatus 300.

FIGS. 5 and 6 show an isometric, partially in section view and an exploded view, respectively, of the example actuator assembly 400. It will be appreciated that the components shown in the exploded view of FIG. 6 are not necessarily shown in the appropriate spatial order or sequence. It will further be appreciated that the illustrated embodiment represents merely one potential non-limiting example embodiment and that other electrical disconnect apparatus and actuating assembly designs (not shown) are expressly contemplated by the disclosed concept.

The example electrical disconnect apparatus 300 includes a seal element, such as for example and without limitation, an O-ring 408. When the enclosure 404 is coupled to the housing 302 (FIGS. 3, 4A and 4B) the seal element 408 seals an interface between the housing 302 and the actuator assembly 400. The base 402 couples the enclosure 404 to the exterior 306 of the housing 302, as best shown in FIG. 3. The enclosure 404 encloses at least a portion of the automatic actuating assembly 600, as best shown in FIG. 5.

The example automatic actuating assembly 600 includes a drive assembly 602 coupled to the mount 604, and an actuator 604 for actuating the drive assembly 602 to move the movable conductor 330 with respect to the housing 302 of the electrical disconnect apparatus 300. In the non-limiting example shown, three pulleys 606,608,610 cooperate with a belt 612 and a number of corresponding threaded rods 614,616 (two are shown).

It will be appreciated, however, that any known or suitable alternative number, type and/or configuration of drive mechanism (not shown) other than the three pulleys 606,608,610, shown, could be employed. For example and without limitation, a suitable gear assembly (not shown) could be alternatively employed. A connector 620, such as for example and without limitation, a substantially planer plate member, is movably connected to the threaded rods 614,616. The exemplary actuator 604 is an electric motor, which is disposed on the first side 410 of the mount 406, and is structured to drive (e.g., rotate) a corresponding one of the pulleys 606, which in turn moves the belt 612 such that pulleys 608,610 rotate the corresponding threaded rods 614,616, respectively. This, in turn, moves the connector 620, which moves the movable conductor 330 between the aforementioned connected (e.g., extended) and disconnected (e.g., retracted) positions of FIGS. 4A and 4B, respectively. The threaded rods 614,616 and connector 620 are also substantially disposed on the first side 410 of the mount 406. The pulleys 606,608,610 and belt 612 are disposed on the second side 412 of the mount.

As previously noted, it will be appreciated that any other known or suitable alternative number, type and/or configuration of drive assembly (not shown) and/or components therefor (e.g., without limitation, actuator 604; pulleys 606,608, 610; belt 612; threaded rods 614,616) could be employed, without departing from the scope of the disclosed concept.

Referring to FIG. 6, the example connector 620 includes first and second segments 622,624, and the example drive assembly 602 further includes a rod extension 630, which is coupled to the first segment 622 and extends between the connector 620 and the movable conductor 630. The aforementioned threaded rods 614,616 are movably coupled to the second segment 624 of the connector 620. The drive assembly 602 preferably further includes a number of support members 640 (three are shown), which extend between the mount 406 and the base 402. The support members 640 function to give the actuator assembly 400 additional structural support and integrity. It will be appreciated that the assembly may further include any known or suitable type and/or number of fasteners and other components as may be necessary or desired for suitable operation.

Referring again to FIG. 5, it will be appreciated that the electric motor 604 can optionally communicate with a suitable controller 700 to actuate the actuator assembly 400, for example, from a remote location, without requiring direct user contact with the electrical disconnect apparatus 300. As previously noted, it will be appreciated that such remote operation may be effectuated via a wired system or a wireless communications system. One example, non-limiting controller 700 capable of performing such function is the VaultGard™, which is available from Eaton Corporation having a place of business at 1000 Eaton Boulevard, Cleveland, Ohio 44122. By way of example, VaultGard™, among other functions, provides monitoring and remote control capabilities for electrical vault systems, acting as a central communications platform to collect vault data, for example, from numerous network protector relays as well as sensors. Thus, among other benefits, the controller 700 can discover network issues before they cause costly system-wide problems. Accordingly, such a controller 700 can be used to log data, and control devices such as the disclosed electrical disconnect apparatus 300, remotely, and monitor the system. Such monitoring can be done, for example and without limitation, using a web page interface or any other known or suitable alternative communications and/or monitoring mechanism or means.

Thus, the disclosed concept provides an Automated Disconnect (AD) containing an electrical interlock that, in operation, ensures the device is not operated if the Network Protector (NP) is in the closed state. This method of protection is achieved by interrupting the power supply to the AD control using, for example, a suitable auxiliary mechanical switch that is integral to the associated NP. When the corresponding breaker is in the open position, the auxiliary mechanical switch allows control power to the AD. When the NP is closed, the auxiliary mechanical switch is open, blocking power to the AD.

As previously discussed, the disclosed electrical disconnect apparatus 300 can also be operated in the conventional manual manner. This can be achieved by way of the manual actuating mechanism 500, which in the example shown and described herein is a manual interlock. The example manual interlock 500 has a collar 502 with a recess 504. The recess 504 cooperates with a corresponding portion of the housing 302 (FIGS. 3, 4A and 4B), for example by pivoting the collar 502 (e.g., without limitation, clockwise or counterclockwise) to mechanically engage the housing 302 and manually lock the movable conductor 330, for example, in the connected (e.g., extended) position of FIG. 4A. Moving (e.g., without limitation, pivoting) the manual interlock 500 such that the recess 504 moves to mechanically disengage the collar 502 from the housing 302, permits the movable conductor 330 to be manually retracted and/or withdrawn to electrically disconnect the electrical disconnect apparatus 300.

Accordingly, the disclosed electrical disconnect apparatus 300 (e.g., without limitation, Network Protector (NP)) provides an effective mechanism that can be operated both manually and remotely thanks to a built-in automatic actuating assembly 600, which can also be automatically safely operated from a remote location.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical disconnect apparatus comprising:

a housing including an interior and an exterior;

a first conductor extending from the exterior into the interior;

a second conductor extending from the exterior into the interior;

a movable conductor having a connected position in which said movable conductor electrically connects said first conductor and said second conductor, and a disconnected position in which said first conductor is electrically disconnected from said second conductor; and an actuator assembly coupled to said housing an being adapted to move said movable conductor between said connected position and said disconnected position;

wherein said actuator assembly can be actuated manually or automatically;

wherein said actuator assembly comprises a base, an enclosure, a mount, a manual actuating mechanism, and an automatic actuating assembly;

wherein said base couples said enclosure to the exterior of said housing; and wherein said enclosure encloses at least a portion of said automatic actuating assembly.

2. The electrical disconnect apparatus of claim 1 wherein said movable conductor is an elongated rod.

3. The electrical disconnect apparatus of claim 2 wherein said first conductor includes a first receptacle and a first flexible conductor disposed around the first receptacle; wherein said second conductor includes a second receptacle and a second flexible conductor disposed around the second receptacle; wherein, when said elongated rod is disposed in said connected position, said elongated rod extends into the interior of said housing through said first flexible conductor and said second flexible conductor thereby electrically connecting said first conductor and said second conductor; and wherein, when said elongated rod is disposed in said disconnected position, said elongated rod is retracted and spaced from said second flexible conductor thereby electrically disconnecting said first conductor and said second conductor.

4. The electrical disconnect apparatus of claim 1 wherein at least one of said base and said housing comprises a seal element; and wherein, when said enclosure is coupled to said housing, said seal element seals an interface between said housing and said actuator assembly.

5. The electrical disconnect apparatus of claim 4 wherein said seal element is an O-ring.

6. The electrical disconnect apparatus of claim 1 wherein said automatic actuating assembly comprises a drive assembly coupled to said mount and an actuator for actuating said drive assembly to move said movable conductor with respect to said housing.

7. The electrical disconnect apparatus of claim 6 wherein said drive assembly comprises a plurality of pulleys, a belt cooperating with said pulleys, a number of threaded rods each being coupled to a corresponding one of said pulleys, and a connector movably coupled to said threaded rods.

8. The electrical disconnect apparatus of claim 7 wherein said actuator is an electric motor; wherein said mount has a first side and a second side disposed opposite the first side; wherein said electric motor, said threaded rods and said connector are substantially disposed on the first side of said mount; and wherein said pulleys and said belt are disposed on the second side of said mount.

9. The electrical disconnect apparatus of claim 8 wherein said connector includes a first segment and a second segment; wherein said drive assembly further comprises a rod extension; wherein said rod extension is coupled to the first segment of said connector and extends between said connector and said movable conductor; and wherein said threaded rods are movably coupled to the second segment of said connector.

10. The electrical disconnect apparatus of claim 9 wherein said drive assembly further comprises a number of support members extending between said mount and said base.

11. The electrical disconnect apparatus of claim 6 wherein said actuator communicates with a controller to actuate said actuator assembly from a remote location, without requiring direct user contact with said electrical disconnect apparatus.

12. The electrical disconnect apparatus of claim 1 wherein said manual actuating mechanism is a manual interlock; wherein said manual interlock is structured to mechanically engage said housing in order to manually lock said movable conductor in said connected position; and wherein said manual interlock is structured to mechanically disengage said housing in order to manually retract and disconnect said movable conductor.

13. The electrical disconnect apparatus of claim 12 wherein said manual interlock comprises a collar coupled to said base; wherein said collar includes a recess; and wherein said recess cooperates with a corresponding portion of said housing.

* * * * *